US006576085B2

(12) United States Patent
Ikeda et al.

(10) Patent No.: US 6,576,085 B2
(45) Date of Patent: Jun. 10, 2003

(54) PAPER BULKING PROMOTER

(75) Inventors: Yasushi Ikeda, Wakayama (JP); Yoichi Ishibashi, Wakayama (JP); Takaaki Tadokoro, Wakayama (JP); Hiromichi Takahashi, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/957,184

(22) Filed: Sep. 21, 2001

(65) Prior Publication Data

US 2002/0096283 A1 Jul. 25, 2002

Related U.S. Application Data

(62) Division of application No. 09/224,804, filed on Dec. 31, 1998, now Pat. No. 6,346,169.

(30) Foreign Application Priority Data

Jan. 13, 1998 (JP) ..... 10-4877

(51) Int. Cl.[7] ..... D21F 11/00

(52) U.S. Cl. ..... 162/158; 162/179; 162/111; 162/112; 162/129; 162/168.1; 162/183; 428/172; 428/156

(58) Field of Search ..... 162/158, 179, 162/111, 112, 129, 183, 168.1; 428/172, 156

(56) References Cited

U.S. PATENT DOCUMENTS

| | | | | |
|---|---|---|---|---|
| 3,554,863 A | * | 1/1971 | Hervey et al. | 162/158 |
| 3,677,886 A | * | 7/1972 | Forssblad et al. | 162/72 |
| 5,102,501 A | | 4/1992 | Eber et al. | |
| 5,302,243 A | | 4/1994 | Ishibashi et al. | |
| 6,033,761 A | | 3/2000 | Dwiggins et al. | |
| 6,083,348 A | | 7/2000 | Auhorn et al. | |
| 6,103,056 A | | 8/2000 | Irinatsu et al. | |
| 6,113,741 A | | 9/2000 | Kettunen et al. | |

FOREIGN PATENT DOCUMENTS

| | | | |
|---|---|---|---|
| AU | 124900 | * | 10/1944 |
| JP | 0045857 | * | 3/1980 |
| JP | 3124895 | | 5/1991 |
| JP | 3269199 | | 11/1991 |
| JP | 4185792 | | 7/1992 |
| JP | 4352891 | | 12/1992 |
| JP | 4370298 | | 12/1992 |
| JP | 5230798 | | 9/1993 |

* cited by examiner

*Primary Examiner*—Peter Chin
*Assistant Examiner*—M. Halpern
(74) *Attorney, Agent, or Firm*—Birch, Stewart, Kolasch & Birch, LLP

(57) ABSTRACT

This invention provides a paper bulking promoter with which a highly bulky sheet can be obtained without impairing paper strength. Namely, this invention provides a process for producing a bulky paper, having the step of making paper from pulp in the presence of a bulking promoter having at least one compound selected from the group consisting of a cationic compound, an amine compound, an acid salt of an amine compound, an amphoteric compound, an amide compound, a quaternary ammonium salt, and an imidazoline derivative.

5 Claims, No Drawings

PAPER BULKING PROMOTER

This application is a divisional of application Ser. No. 09/224,804, filed on Dec. 31, 1998, now U.S. Pat. No. 6,346,169, the entire contents of which are hereby incorporated by reference and for which priority is claimed under 35 U.S.C. §120; and this application claims priority of Application No. 10-4877 filed in JAPAN on Jan. 13, 1998 under 35 U.S.C. § 119.

BACKGROUND OF THE PRIOR ART

1. Technical Field

This invention relates to a paper bulking promoter with which the sheets of paper obtained from a pulp feedstock can be bulky without impairing paper strength.

2. Description of the Prior Art

Recently, there is a desire for high-quality paper, e.g., paper excellent in printability and voluminousness. Since the printability and voluminousness of paper are closely related to the bulkiness thereof, various attempts have been made to improve bulkiness. Examples of such attempts include a method in which a crosslinked pulp is used (JP-A 4-185792, etc.) and a method in which a mixture of pulp with synthetic fibers is used as a feedstock for papermaking (JP-A 3-269199, etc.). Examples thereof further include a method in which spaces among pulp fibers are filled with a filler such as an inorganic (JP-A 3-124895, etc.) and a method in which spaces are formed (JP-A 5-230798, etc.). On the other hand, with respect to mechanical improvements, there is a report on an improvement in calendering, which comprises conducting calendering under milder conditions (JP-A 4-370298).

However, the use of a crosslinked pulp, synthetic fibers, etc. makes pulp recycling impossible, while the technique of merely filling pulp fiber spaces with a filler and the technique of forming spaces result in a considerable decrease in paper strength. Furthermore, the improvement in mechanical treatment produces only a limited effect and no satisfactory product has been obtained so far.

Also known is a method in which a bulking promoter is added during papermaking to impart bulkiness to the paper. Although fatty acid polyamide polyamines for use as such bulking promoters are on the market, use of these compounds results in a decrease in paper strength and no satisfactory performance has been obtained therewith.

SUMMARY OF THE INVENTION

The inventors have made intensive investigations in view of the problems described above. As a result, they have found that by incorporating at least one compound selected among specific cat ionic compounds, amine compounds, acid salts of amine compounds, amphoteric compounds, amide compounds, quaternary ammonium salts, and imidazoline derivatives, optionally together with at least one specific nonionic surfactant into a pulp feedstock, e.g., a pulp slurry, in the papermaking step, the sheet made from the feedstock can have improved bulkiness without detriment to paper strength. This invention has thus been achieved.

Namely, this invention provides a process for producing a bulky paper, comprising the step of making paper from pulp in the presence of a bulking promoter comprising at least one compound selected from the group consisting of a cationic compound, an amine compound, an acid salt of an amine compound, an amphoteric compound, an amide compound, a quaternary ammonium salt, and an imidazoline derivative.

The term "paper bulking promoter" used herein means an agent with which a sheet of paper obtained from a pulp feedstock can have a larger thickness (can be bulkier) than that having the same basis weight obtained from the same amount of a pulp feedstock.

DETAILED DESCRIPTION OF THE PREFERRED EMBODIMENT

Examples of the cationic compounds for use in this invention include compounds represented by the following formulae ($a_1$) and ($b_1$):

($a_1$)

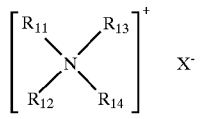

($b_1$)

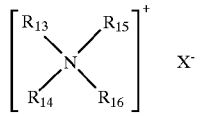

wherein $R_{11}$ and $R_{12}$ are the same as or different from each other, and an alkyl, alkenyl or β-hydroxyalkyl group having 8 to 24 carbon atoms; $R_{13}$, $R_{14}$ and $R_{15}$ are the same as or different from each other, and an alkyl or hydroxyalkyl group having 1 to 8 carbon atoms, benzyl or —(AO)$n_{11}$—$Z_{11}$ wherein AO is an oxyalkylene unit having 2 or 3 carbon atoms, $Z_{11}$ is a hydrogen atom or an acyl group and $n_{11}$ is an integer of 1 to 50; $R_{16}$ is an alkyl, alkenyl or β-hydroxyalkyl group having 8 to 36 carbon atoms; and $X^-$ is an anionic ion.

In the formula ($a_1$), $R_{11}$ and $R_{12}$, which are the same or different, each preferably is an alkyl or alkenyl group having 10 to 22 carbon atoms. $R_{13}$ and $R_{14}$, which are the same or different, each preferably is a hydrogen atom or an alkyl group having 1 to 3 carbon atoms. Examples of $X^-$, which is an anionic ion, include hydroxy, halide, and monoalkyl (C1–C3) sulfate ions and anions derived from inorganic or organic acids. $X^-$ is preferably a halide ion, especially $Cl^-$.

In the formula ($b_1$), $R_{13}$, $R_{14}$, and $R_{15}$, which are the same or different, each is preferably an alkyl group having 1 to 3 carbon atoms or a benzyl group. $R_{16}$ is preferably an alkyl group having 10 to 22 carbon atoms. Examples of the anionic ion $X^-$ are the same as those in the formula ($a_1$). $X^-$ is preferably a halide ion, especially $Cl^-$.

In the present invention, the cationic compounds may include quaternary ammonium salts.

Hereinafter $X^-$ may be an anionic ion as an anionic ion.

Examples of the amine compounds and the acid salts of amine compounds for use in this invention include compounds represented by the following formulae ($a_2$) to ($f_2$):

($a_2$)

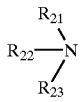

($b_2$)

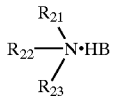

-continued (c2)

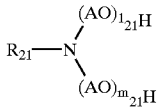

(d2)

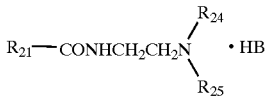

(e2)

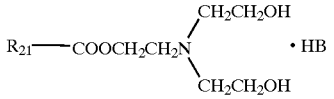

(f2)

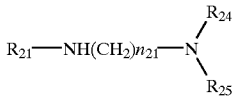

wherein $R_{21}$ is an alkyl, alkenyl or β-hydroxyalkyl group having 8 to 36 carbon atoms; $R_{22}$ and $R_{23}$ are the same as or different from each other, and a hydrogen atom, an alkyl group having 1 to 24 carbon atoms or an alkenyl group having 2 to 24 carbon atoms; $R_{24}$ and $R_{25}$ are the same as or different from each other, and a hydrogen atom or an alkyl group having 1 to 3 carbon atoms; HB represents an inorganic acid or an organic acid; AO is an oxyalkylene unit having 2 or 3 carbon atoms; $l_{21}$ and $m_{21}$ are 0 or a positive integer, and the sum in total of $l_{21}$ and $m_{21}$ is in an integer ranging from 1 to 300; and $n_{21}$is a number of 1 to 4.

In the formulae ($a_2$) to ($f_2$), $R_{21}$ is preferably an alkyl group having 10 to 22 carbon atoms. $R_{22}$ and $R_{23}$, which are the same or different, each preferably is a hydrogen atom or an alkyl group having 1 to 22 carbon atoms. In HB in the acid salts of amine compounds, B is preferably a halogen or a carboxylate having 2 to 5 carbon atoms, especially preferably a carboxylate having 2 or 3 carbon atoms. Preferred amine compounds and preferred acid salts of amine compounds are the compounds represented by the formulae ($a_2$) and ($b_2$) respectively.

The acid salt represented by the formula ($b_2$) may be signified by the following formula ($b_{21}$):

($b_{21}$)

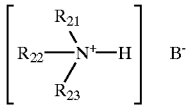

wherein $R_{21}$, $R_{22}$ and $R_{23}$ are same as above-mentioned; H is hydrogen atom; and $B^-$ represents a base That is, the acid salt may be an ionized compound.

Examples of the amphoteric compounds for use in this invention include compounds represented by the following formulae ($a_3$) to (j3):

($a_3$)

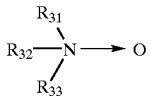

-continued ($b_3$)

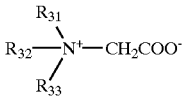

($c_3$)

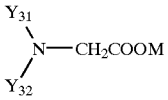

($d_3$)

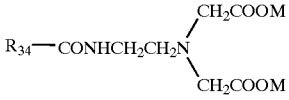

($e_3$)

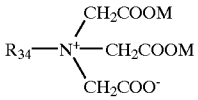

($f_3$)

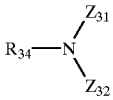

($g_3$)

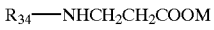

($h_3$)

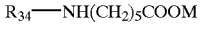

($i_3$)

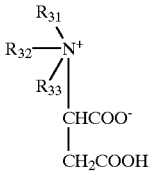

($j_3$)

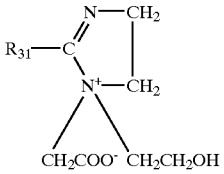

wherein $R_{31}$, $R_{32}$ and $R_{33}$ are the same as or different from each other, and an alkyl group having 1 to 24 carbon atoms or an alkenyl group having 2 to 24 carbon atoms; $R_{34}$ is an alkyl, alkenyl or β-hydroxyalkyl group having 8 to 36 carbon atoms; M is a hydrogen atom, an alkali metal atom, a half a mole of an alkaline earth metal atom or an ammonium group; $Y_{31}$ is $R_{35}NHCH_2CH_2$—, wherein $R_{35}$ is an alkyl group having 1 to 36 carbon atoms, or an alkenyl or a hydroxy alkyl group having 2 to 36 carbon atoms; $Y_{32}$ is a hydrogen atom or $R_{35}NHCH_2CH_2$—, $R_{35}$ being defined above; $Z_{31}$ is —$CH_2COOM$, M being defined above; and $Z_{32}$ is a hydrogen atom or —$CH_2COOM$, M being defined above.

In the formulae ($a_3$) to ($j_3$), $R_{31}$, $R_{32}$, and $R_{33}$, which are the same or different, each preferably is an alkyl group having 1 to 22 carbon atoms. Especially preferably, $R_{31}$ is an alkyl group having 10 to 20 carbon atoms, and $R_{32}$ and $R_{33}$ each is an alkyl group having 1 to 3 carbon atoms. $R_{34}$ is preferably an alkyl group having 10 to 22 carbon atoms. Preferred amphoteric compounds are those represented by the formulae ($a_3$) and ($b_3$)

Examples of the other amine compounds and the other acid salts of an amine compound for use in this invention include compounds represented by the following formulae ($a_4$) to ($d_4$):

($a_4$)

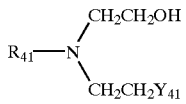

($b_4$)

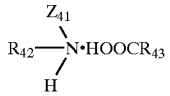

($c_4$)

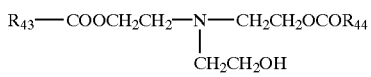

($d_4$)

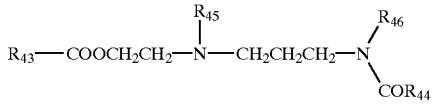

wherein $R_{41}$ is an alkyl, alkenyl or β-hydroxyalkyl having 8 to 35 carbon atoms; $R_{43}$ and $R_{44}$ are same as or different from each other, an alkyl, alkenyl or β-hydroxyalkyl group having 7 to 35 carbons atoms; $R_{46}$ is a hydrogen atom or an alkyl group having 1 to 3 carbon atoms; $R_{45}$ is an alkyl group having 1 to 3 carbon atoms; $R_{42}$ is a hydrogen atom or $R_{47}$, wherein $R_{47}$ is an alkyl, alkenyl or β-hydroxyalkyl group having 7 to 35 carbons atoms; $Y_{41}$ is a hydrogen or —$COR_{44}$; and $Z_{41}$ is —$CH_2CH_2O(AO)n_{41}$—$OCOR_{47}$, wherein A is a liner or branched alkylene unit having 2 to 3 carbon atoms, or —$CH_2CH(OH)$—$CH_2OCOR_{47}$ and $n_{41}$is an average added-number ranging 1 to 20.

Examples of the amide compounds for use in this invention include compounds represented by the following formulae ($a_5$) and ($b_5$):

($a_5$)

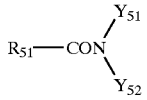

($b_5$)

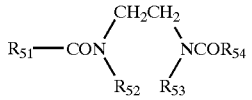

wherein $R_{51}$ and $R_{54}$ are same as or different from each other, an alkyl, alkenyl or β-hydroxyalkyl group having 7 to 35 carbon atoms; $R_{52}$ and $R_{53}$ are same as or different from each other, a hydrogen atom or an alkyl group having 1 to 3 carbon atoms; and $Y_{51}$ and $Y_{52}$ are same as or different from each other, and a hydrogen atom, $R_{52}CO$—, $R_{54}CO$—, —$(AO)n_{51}$—$COR_{55}$, wherein A is a liner or branched alkylene unit having 2 to 3 carbon atoms $n_{51}$ is an average added-number ranging 1 to 20, and $R_{55}$ is an alkyl, alkenyl or β-hydroxyalkyl group having 7 to 35 carbon atoms, or —$(AO)n_{51}$—H, wherein A and $n_{51}$ are defined above.

Examples of the cationic compounds for use in this invention include quaternary ammonium salts represented by the following formulae ($a_6$) and ($b_6$):

($a_6$)

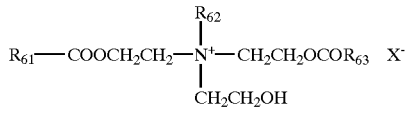

($b_6$)

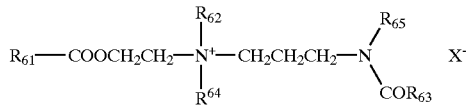

wherein $R_{61}$ and $R_{63}$ are same as or different from each other, an alkyl, alkenyl or β-hydroxyalkyl group having 7 to 35 carbons atoms; $R_{65}$ is a hydrogen atom or an alkyl group having 1 to 3 carbon atoms; $R_{62}$ and $R_{64}$ are same as or different from each other, an alkyl group having 1 to 3 carbon atoms; and $X^-$ is an anionic ion.

Examples of the imidazoline derivative for use in this invention include compounds represented by the following formulae ($a_7$):

($a_7$)

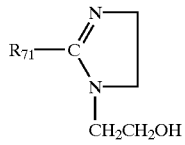

wherein $R_{71}$ is an alkyl, alkenyl or β-hydroxyalkyl group having 7 to 35 carbons atoms.

The paper bulking promoter of this invention preferably further contains at least one specific nonionic surfactant. By the use of at least one of compounds represented by the above formulae ($a_1$) and ($b_1$), ($a_2$) to ($e_2$), ($a_3$) to ($h_3$), ($a_4$) to ($d_4$), ($a_5$) and ($b_5$), ($a_6$) and ($b_6$), and ($a_7$); and at least one specific nonionic surfactant in combination, the effect of this invention can be improved. Examples of the nonionic surfactant for use in this invention include the following (A) to (C).

(A): a compound represented by the following formula (A)

$$R_{81}O(EO)_{m_{81}}(PO)_{n_{81}}H \quad (A)$$

wherein $R_{81}$ is a C6 to C22 straight or branched alkyl or alkenyl group or an alkylaryl group having a C4 to C20 alkyl group; E is an ethylene unit; P is a propylene unit; $m_{81}$ and $n_{81}$ are an average number of added moles, $m_{81}$ is a number in the range of 0 to 20 and $n_{81}$ is a number in the range of 0 to 50; and the addition form of EO and PO may be any of block and random and the addition order of EO and PO may be not limited.

The compounds represented by the formula (A) are ones each obtained by causing a higher alcohol, an alkylphenol, or the like in which the alkyl has 6 to 22 carbon atoms to add an alkylene oxide such as ethylene oxide (EO) or propylene oxide (PO). In this invention is used the compound in which the average number of moles of ethylene oxide added is in the range of $0 \leqq m_{81} \leqq 20$. The range of the average number of moles added, $m_{81}$, is preferably $0 \leqq m_{81} \leqq 10$, more preferably $0 \leqq m_{81} \leqq 5$. If $m_{81}$ exceeds 20, the effect of imparting bulkiness to paper is lessened. Further, the compound used is one in which the average number of moles of propylene oxide (PO) added, $n_{81}$, is in the range of $0 \leqq n_{81} \leqq 50$, preferably $0 \leqq n_{81} \leqq 20$. When $n_{81}$ exceeds 50, such a compound is economically disadvantageous although the decrease in performance is little.

$R_{81}$ in the formula (A) is preferably a linear or branched, alkyl or alkenyl group having 8 to 18 carbon atoms. If $R_{81}$ in the formula (A) is an alkyl or alkenyl group in which the number of carbon atoms is outside the range of from 6 to 22 or if $R_{81}$ is an alkylaryl group in which the number of carbon atoms of the alkyl group is outside the range of from 4 to 20, then the compound is less effective in imparting bulkiness to paper.

Examples of E and P in the formula (A), which each represents a linear or branched alkylene group having 2 or 3 carbon atoms, include ethylene and propylene. When the group $(EO)_{m_{81}}(PO)_{n_{81}}$ in the formula (A) is composed of a combination of polyoxyethylene and polyoxypropylene, the $C_2H_4O$ and $C_3H_6O$ units may have any of random and block arrangements (,or the addition form of EO and PO may be any of block and random). In this case, the polyoxypropylene ($C_3H_6O$) group(s) account for preferably at least 50 mol %, especially preferably at least 70 mol %, of all groups added on the average. The alkylene oxide group bonded to R may begin with any of EO and PO (or the addition order of EO and PO may be not limited).

(B): Compounds represented by the following formula (B)

$$R_{81}COO(EO)_{m_{81}}(PO)_{n_{81}}R_b \quad \text{(B)}$$

wherein $R_{81}$, E, P, $m_{81}$ and $n_{81}$ are the same as those of the formula (A); and $R_b$ is H, an alkyl, an alkenyl or an alkylaryl group.

Preferred examples of $R_{81}$, E, P, $m_{81}$, and $n_{81}$ in the formula (B) are the same as those in the formula (A). Examples of the alkyl and alkenyl groups represented by $R_b$ in the formula (B) include those having 1 to 4 carbon atoms, while examples of the alkylaryl group represented by $R_b$ include alkylphenyl groups in each of which the alkyl has 1 to 4 carbon atoms.

(C) a nonionic surfactant selected from the following (1) to (3)

(1) an oil-fat type nonionic surfactant (i.e. a nonionic surfactant based on fat), (2) a sugar-alcohol type nonionic surfactant (i.e. a nonionic surfactant based on sugar alcohol) and (3) a sugar-type nonionic surfactant (i.e. a nonionic surfactant based on sugar)

(1) Nonionic Surfactants Based on Fat

Examples of the nonionic surfactants based on a fat (1) include ones obtained by mixing an alcohol having 1 to 14 hydroxy groups with a fat such as those given in, e.g., JP-A 4-352891 or with a product of the reaction of the fat with glycerol and causing the mixture to add an alkylene oxide (AO) Preferred is one obtained by causing a mixture of a fat and a polyhydric alcohol to add an AO. The AO is ethylene oxide (EO) and/or propylene oxide (PO). In the case of using both EO and PO, the EO/PO polymer may have any of random and block arrangements. The average number of moles of EO added is preferably 0 to 200, more preferably 10 to 100, while that of PO added is preferably 0 to 150, more preferably 2 to 100.

Examples of the fat usable for this type of nonionic surfactant include land animal fats, marine animal fats, hardened or semihardened oils obtained therefrom, and recovery oils obtained during the purification of these fats. Preferred examples thereof include coconut oil, beef tallow, fish oils, linseed oil, rapeseed oil, and castor oil. In the case where any of these fats is reacted beforehand with glycerol, the fat/glycerol ratio is preferably from 1/0.05 to 1/1.

Examples of monohydric alcohols among the alcohols having 1 to 14 hydroxy groups usable for this type of nonionic surfactant include linear or branched, saturated or unsaturated alcohols having 1 to 24 carbon atoms and cyclic alcohols. Preferred are linear or branched, saturated alcohols having 4 to 12 carbon atoms. Examples of dihydric alcohols include α,ω-glycols having 2 to 32 carbon atoms, 1,2-diols, symmetric α-glycols, and cyclic 1,2-diols. Preferred are α,ω-glycols having 2 to 6 carbon atoms. Examples of trihydric and higher alcohols include those having 3 to 24 carbon atoms, such as glycerol, diglycerol, sorbitol, and stachyose. Especially preferred alcohols are di- to hexahydric alcohols having 2 to 6 carbon atoms.

(2) Nonionic Surfactants Based on Sugar Alcohol

Examples of the nonionic surfactants based on a sugar alcohol (2) include sugar alcohol/AO adducts, fatty acid esters of sugar alcohol/AO adducts, and fatty acid esters of sugar alcohols. The sugar alcohol as a component of a nonionic surfactant based on a polyhydric alcohol is an alcohol obtained from a monosaccharide having 3 to 6 carbon atoms through reduction of the aldehyde or ketone group. Examples thereof include glycerol, erythritol, arabitol, sorbitol, and mannitol. Especially preferred are those having 6 carbon atoms. The fatty acid as a component of the fatty acid ester in a sugar alcohol/AO adduct may be any of saturated and unsaturated fatty acids each having 1 to 24, preferably 12 to 18, carbon atoms. Preferred is oleic acid. With respect to the degree of esterification of the sugar alcohol, the number of OH groups which have undergone esterification may be any of from zero to all of the OH groups. However, the degree of esterification is preferably 1 to 3. The kinds of AO and the average number of moles of AO added are the same as in (1)

(3) Nonionic Surfactants Based on Sugar

Examples of the nonionic surfactants based on a sugar (3) include sugar/AO adducts, fatty acid esters of sugar/AO adducts, and sugar/fatty acid esters. The sugar may be a polysaccharide such as sucrose, besides any of the monosaccharides mentioned above with regard to the sugar alcohol. Preferred are glucose and sucrose. The kinds of AO and the average number of moles of AO added are the same as in (1). Especially preferred of the nonionic surfactants based on a sugar (3) are sugar/AO adducts, in particular, glucose/PO adducts in which the average number of moles of PO added is 1 to 10.

When at least one compound (i) selected among cationic compounds, amine compounds, acid salts of amine compounds, amphoteric compounds, amide compounds, quaternary ammonium salts, and imidazoline derivatives is used in combination with at least one nonionic surfactant (ii) such as the compounds (A) to (C) described above, the proportion of the compound (i) to the nonionic surfactant (ii) is from 100/0 to 1/99, preferably from 100/0 to 10/90 by weight.

The compounds (i) and (ii) maybe added either as a mixture of both or separately.

The bulking promoter of this invention is applicable to a variety of ordinary pulp feedstocks ranging from virgin pulps such as mechanical pulps and chemical pulps to pulps prepared (deinked) from various waste papers. The point where the bulking promoter of this invention is added is not particularly limited as long as it is within the papermaking process steps. In a factory, for example, the bulking promoter is desirably added at a point where it can be evenly blended with a pulp feedstock, such as, the refiner, machine chest, or headbox. After the bulking promoter of this invention is added to a pulp feedstock, the resultant mixture is subjected as it is to sheet forming. The bulking promoter remains in the paper. The paper bulking promoter of this invention is added in an amount of 0.01 to 10 wt. %, preferably 0.1 to 5 wt. %, based on the pulp.

The pulp sheet obtained by using the paper bulking promoter of this invention has a bulk density (the measurement method is shown in the Examples given later) lower by desirably at least 5%, preferably at least 7% than the product not containing the paper bulking promoter and has a tearing strength as measured according to JIS P 8116 of desirably at least 90%, preferably at least 95% of that of the product.

EXAMPLES

This invention will be explained below in more detail by reference to Examples, but the invention should not be construed as being limited thereto. In the Examples, all parts and percents are based on weight unless otherwise indicated.

When the unit number of an (AO) group is defined by an integer, the compound is one of a mixture of reaction products. When it is defined by an average value, the compound is a mixture of reaction products.

Examples 1 to 42 and Comparative Example 1

Pulp Feedstocks

The deinked pulp and virgin pulp shown below were used as pulp feedstocks.

Deinked Pulp

A deinked pulp was obtained in the following manner. To feedstock waste papers collected in the city (newspaper/leaflet=70/30%) were added warm water, 1% (based on the feedstock) of sodium hydroxide, 3% (based on the feedstock) of sodium silicate, 3% (based on the feedstock) of a 30% aqueous hydrogen peroxide solution, and 0.3% (based on the feedstock) of EO/PO block adduct of beef tallow/glycerol (1:1), as a deinking agent, in which the amounts of EO and PO were respectively 70 and 10 (average number of moles added). The feedstock was disintegrated and then subjected to flotation. The resultant slurry was washed with water and regulated to a concentration of 1% to prepare a deinked pulp (DIP) slurry. This DIP had a freeness of 220 ml.

Virgin Pulp

A virgin pulp was prepared by disintegrating and beating an LBKP (bleached hardwood pulp) with a beater at room temperature to give a 1% LBKP slurry. This LBKP had a freeness of 420 ml.

Bulking Promoters

The cationic compounds, amine compounds, acids salts of amine compounds, and amphoteric compounds shown in Tables 1 to 5 were used optionally together with the nonionic surfactants shown in Table 6 in the combinations shown in Tables 7 and 8, which will be given later.

TABLE 1

| Compound | Structure in the formula (a1) | | | | |
|---|---|---|---|---|---|
| No. | $R_{11}$ | $R_{12}$ | $R_{13}$ | $R_{14}$ | $X^-$ |
| Cationic compound | | | | | |
| A-1 | C18 | C18 | C1 | C1 | $Cl^-$ |
| A-2 | C12 | C14 | C1 | C1 | $Cl^-$ |
| a-1 | C2 | C2 | C1 | C1 | $Cl^-$ |
| a-2 | C4 | C4 | C1 | C1 | $Br^-$ |

TABLE 2

| Compound | Structure in the formula (b1) | | | | |
|---|---|---|---|---|---|
| No. | $R_{13}$ | $R_{14}$ | $R_{15}$ | $R_{16}$ | $X^-$ |
| Cationic compound | | | | | |
| B-1 | C1 | C1 | C1 | C12 | $Cl^-$ |
| B-2 | C1 | C1 | C1 | C16 | $Br^-$ |
| B-3 | C1 | C1 | C1 | C18 | $Cl^-$ |
| B-4 | benzyl | C1 | C1 | C12 | $Cl^-$ |
| b-1 | C1 | C1 | C1 | C2 | $Cl^-$ |
| b-2 | C1 | C1 | C1 | C4 | $Br^-$ |

TABLE 3

| Compound | Structure in the formula (a2) or ($b_2$) | | | |
|---|---|---|---|---|
| No. | $R_{21}$ | $R_{22}$ | $R_{23}$ | HB |
| Amine compound and acid salt of amine compound | | | | |
| C-1 | C12 | H | H | — |
| C-2 | C18 | H | H | — |
| C-3 | C16/C18 = 3/7 | C16/C18 = 3/7 | H | — |
| C-4 | C18 | C1 | C1 | — |
| c-1 | C4 | H | H | — |
| c-2 | C6 | H | H | — |
| c-3 | C2 | C2 | H | — |
| c-4 | C4 | C1 | C1 | — |
| C-5 | C16/C18 = 3/7 | H | H | $CH_3COOH$ |
| c-5 | C4 | H | H | $CH_3COOH$ |

TABLE 4

| | | Structure in the formula ($a_3$) | | |
|---|---|---|---|---|
| | Compound No. | $R_{31}$ | $R_{32}$ | $R_{33}$ |
| Amphoteric compound | D-1 | C12 | C1 | C1 |
| | d-1 | C4 | C1 | C1 |

TABLE 5

| | | Structure in the formula ($b_3$) | | |
|---|---|---|---|---|
| | Compound No. | $R_{31}$ | $R_{32}$ | $R_{33}$ |
| Amphoteric compound | D-2 | C12 | C1 | C1 |
| | D-3 | C18 | C1 | C1 |
| | d-2 | C6 | C1 | C1 |

TABLE 6

| | Nonionic surfactant | | | (1)/(2)/(3) Weight |
|---|---|---|---|---|
| No. | (1) | (2) | (3) | ratio |
| 1 | C12 alcohol | | | 100/0/0 |
| 2 | C12/C14 alcohol = 5/5 PO = 5 | | | 100/0/0 |
| 3 | Beef tallow/fatty acid, PO = 5 | | | 100/0/0 |

TABLE 6-continued

| No. | Nonionic surfactant (1) | (2) | (3) | (1)/(2)/(3) Weight ratio |
|---|---|---|---|---|
| 4 | Methyl laurate, EO2/PO3 block | | | 100/0/0 |
| 5 | Coconut oil/glycerol = 1/1, EO2/PO10 block | | | 100/0/0 |
| 6 | Sorbitan monoo-leate. EO20 | | | 100/0/0 |
| 7 | Dobanol23 EO2/PO4 random | Sorbitan monooleate, EO10 | | 75/25/0 |
| 8 | C12 alcohol | Sorbitan monooleate, EO15 | Hardened castor oil, EO25 | 80/15/5 |
| 9 | C18 alcohol, PO = 10 | | | 100/0/0 |
| 10 | Castor oil/fatty acid, EO5/PO15 random | | | 100/0/0 |
| 11 | C12/C14/C18 alcohol = 6/2/2, PO = 10 | C12 alcohol EO = 5 | Fish oil/ sorbitol = 1/1, PO = 15 | 75/15/ 10 |
| 12 | Beef tallow/ glycerol = 1/0.3 EO10/PO10 block | | | 100/0/0 |
| 13 | Sorbitan mono-laurate, EO15 | | | 100/0/0 |
| 14 | C12/C14/C18 alcohol = 60/30/10, PO20 | lauric acid EO5, PO25 | | 90/10/0 |
| 15 | C12/C14 alcohol = 70/30 | | | 100/0/0 |
| 16 | Lauric acid/stearic acid = 50/50, PO = 18 | | | 100/0/0 |
| 17 | Dobanol23, PO = 2 | lauric acid/myristic acid/palmitic acid = 70/20/10, EO10, PO20 | Sorbitan trioleate EO6 | 70/15/ 15 |

(Note) In the table, Cn means an alkyl group having n carbon atoms. In Table 6, each fat/polyhydric alcohol ratio is by mole, and the other ratios are by weight. EO and PO mean ethylene oxide and propylene oxide, respectively, and the numbers following these are the average numbers of moles added. "Dobanol 23" is an alcohol manufactured by Mitsubishi Chemical.

Papermaking Method

Each of the above 1% pulp slurries was weighed out in such an amount as to result in a sheet of paper having a basis weight of 60 g/m$^2$. The pH thereof was adjusted to 4.5 with aluminum sulfate. Subsequently, various bulking promoters shown in Tables 7 and 8 were added in an amount of 3% based on the pulp. Each resultant mixture was formed into a sheet with a rectangular TAPPI paper machine using an 80-mesh wire. The sheet obtained was pressed with a press at 3.5 kg/cm$^2$ for 2 minutes and dried with a drum dryer at 105° C. for 1 minute. After each dried sheet was held under the conditions of 20° C. and a humidity of 65% for 1 day to regulate its moisture content, it was evaluated for bulk density as a measure of paper bulkiness and for tearing strength as a measure of paper strength performance. The results obtained are shown in Tables 7 and 8. Ten found values were averaged.

Evaluation Item and Method

Bulkiness (Bulk Density)

The basis weight (g/m$^2$) and thickness (mm) of each sheet having a regulated moisture content were measured, and its bulk density (g/cm$^3$) was determined as a calculated value.

Equation for calculation:

$$\text{Bulkiness (bulk density)}=(\text{basis weight})/(\text{thickness})\times 0.001$$

The smaller the absolute value of bulk density, the higher the bulkiness. A difference of 0.02 in bulk density is sufficiently recognized as a significant difference.

Paper Strength (Tearing Strength)

Each sheet having a regulated moisture content was examined according to JIS P 8116 (Testing Method for Tearing Strength of Paper and Paperboard).

Equation for calculation:

$$\text{Tearing strength}=A/S\times 16$$

Tearing strength: (gf)

A: Reading

S: Number of torn sheets

The larger the absolute value of tearing strength, the higher the paper strength. A difference of 20 gf in tearing strength is sufficiently recognized as a significant difference.

TABLE 7

| Example | Cationic compound, amine compound, acid salt of amine compound, or amphoteric compound (i) | Nonionic surfactant used in combination (ii) | (i)/(ii) weight ratio | Deinked Pulp Bulk density (g/cm$^3$) | Deinked Pulp Tearing strength (gf) | LBKP Bulk density (g/cm$^3$) | LBKP Tearing strength (gf) |
|---|---|---|---|---|---|---|---|
| 1 | B-1 | none | — | 0.330 | 420 | 0.377 | 480 |
| 2 | B-2 | ↑ | — | 0.328 | 420 | 0.376 | 480 |
| 3 | B-3 | ↑ | — | 0.325 | 415 | 0.374 | 475 |
| 4 | B-4 | ↑ | — | 0.330 | 415 | 0.378 | 480 |
| S | A-1 | ↑ | — | 0.325 | 420 | 0.375 | 475 |
| 6 | A-2 | ↑ | — | 0.330 | 420 | 0.377 | 480 |
| 7 | C-1 | ↑ | — | 0.342 | 430 | 0.385 | 485 |
| 8 | C-2 | ↑ | — | 0.340 | 430 | 0.383 | 485 |
| 9 | C-3 | ↑ | — | 0.338 | 425 | 0.383 | 480 |
| 10 | C-4 | ↑ | — | 0.335 | 420 | 0.379 | 480 |
| 11 | C-5 | ↑ | — | 0.332 | 420 | 0.377 | 480 |
| 12 | D-1 | ↑ | — | 0.331 | 415 | 0.377 | 475 |

TABLE 7-continued

| Example | Cationic compound, amine compound, acid salt of amine compound, or amphoteric compound (i) | Nonionic surfactant used in combination (ii) | (i)/(ii) weight ratio | Deinked Pulp Bulk density (g/cm$^3$) | Deinked Pulp Tearing strength (gf) | LBKP Bulk density (g/cm$^3$) | LBKP Tearing strength (gf) |
|---|---|---|---|---|---|---|---|
| 13 | D-2 | ↑ | — | 0.331 | 415 | 0.377 | 475 |
| 14 | D-3 | ↑ | — | 0.328 | 420 | 0.375 | 475 |
| 15 | B-1 | 1 | 20/80 | 0.313 | 410 | 0.349 | 470 |
| 16 | B-3 | 2 | 30/70 | 0.308 | 400 | 0.342 | 460 |
| 17 | B-3 | 3 | 50/50 | 0.309 | 405 | 0.344 | 455 |
| 18 | B-3 | 4 | 85/15 | 0.312 | 410 | 0.346 | 460 |
| 19 | B-3 | 5 | 90/10 | 0.314 | 410 | 0.349 | 465 |
| 20 | A-1 | 6 | 85/15 | 0.309 | 400 | 0.345 | 460 |
| 21 | B-4 | 7 | 30/70 | 0.310 | 405 | 0.345 | 455 |
| 22 | B-3 | 8 | 20/80 | 0.308 | 400 | 0.341 | 460 |
| 23 | C-2 | 9 | 65/35 | 0.324 | 410 | 0.360 | 470 |
| 24 | C-3 | 10 | 80/20 | 0.323 | 415 | 0.358 | 470 |
| 25 | C-4 | 11 | 10/90 | 0.317 | 415 | 0.355 | 465 |
| 26 | C-5 | 12 | 70/30 | 0.321 | 410 | 0.357 | 465 |
| 27 | C-5 | 13 | 55/45 | 0.322 | 415 | 0.357 | 470 |
| 28 | C-5 | 14 | 20/80 | 0.319 | 415 | 0.356 | 465 |
| 29 | D-1 | 15 | 15/85 | 0.314 | 410 | 0.348 | 460 |
| 30 | D-3 | 16 | 80/20 | 0.312 | 405 | 0.345 | 460 |
| 31 | D-3 | 17 | 35/65 | 0.308 | 400 | 0.342 | 455 |

TABLE 8

| Example | Cationic compound, amine compound, acid salt of amine compound, or amphoteric compound (i) | Nonionic surfactant used in combination (ii) | Deinked pulp Bulk density (g/cm$^3$) | Deinked pulp Tearing strength (gf) | LBKP Bulk density (g/cm$^3$) | LBKP Tearing strength (gf) |
|---|---|---|---|---|---|---|
| 32 | b-1 | none | 0.366 | 440 | 0.405 | 495 |
| 33 | b-2 | ↑ | 0.365 | 440 | 0.402 | 485 |
| 34 | a-1 | ↑ | 0.365 | 435 | 0.404 | 490 |
| 35 | a-2 | ↑ | 0.366 | 430 | 0.405 | 490 |
| 36 | c-1 | ↑ | 0.367 | 435 | 0.404 | 495 |
| 37 | c-2 | ↑ | 0.368 | 430 | 0.407 | 490 |
| 38 | c-3 | ↑ | 0.365 | 425 | 0.404 | 490 |
| 39 | c-4 | ↑ | 0.365 | 435 | 0.403 | 485 |
| 40 | c-5 | ↑ | 0.366 | 430 | 0.405 | 490 |
| 41 | d-1 | ↑ | 0.364 | 440 | 0.404 | 495 |
| 42 | d-2 | ↑ | 0.363 | 430 | 0.406 | 490 |
| Control (no bulking promoter) | | | 0.375 | 430 | 0.414 | 490 |
| Comparative example 1 | | | 0.330 | 280 | 0.379 | 345 |

(Note) In Comparative Example 1 was used commercial bulking promoter "Bayvolume P Liquid" (fatty acid polyamide polyamine type; manufactured by Bayer AG).

What is claimed is:

1. A process for producing a bulky paper for printing, comprising the step of making paper from a pulp feedstock in the presence of a bulking promoter, wherein said bulking promoter is added to the pulp feedstock and evenly blended with the pulp feedstock in a papermaking process step, and said bulking promoter comprising at least one compound selected from the group consisting of, an amine compound, AND an acid salt of an amine compound, wherein the amine compound and an acid salt of an amine compound are compounds represented by the following formulae ($a_2$) to ($f_2$):

($a_2$)

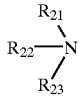

($b_2$)

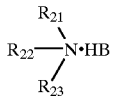

-continued (c2)

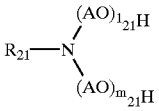

(d2)

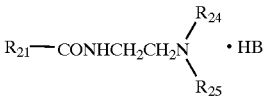

(e2)

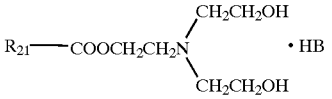

(f2)

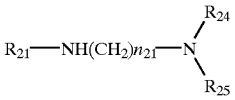

wherein $R_{21}$ is an alkyl, alkenyl or β-hydroxylakyl group having 8 to 36 carbon atoms; $R_{22}$ and $R_{23}$ are the same as or different from each other, and a hydrogen atom, an alkyl group having 1 to 24 carbon atoms or an alkenyl group having 2 to 24 carbon atoms;

$R_{24}$ and $R_{25}$ are the same as or different from each other, and a hydrogen atom or an alkyl group having 1 to 3 carbon atoms;

HB represents an inorganic acid or an organic acid;

AO is an oxyalkylene unit having 2 or 3 carbon atoms;

$l_{21}$ and $M_{21}$ are 0 or a positive integer, and the sum in total of $l_{21}$ and $M_{21}$ is in an integer ranging from 1 to 300; and $N_{21}$ is a number of 1 to 4.

2. A process for producing a bulky paper for printing, comprising the step of making paper from a pulp feedstock in the presence of a bulking promoter, wherein said bulking promoter is added to the pulp feedstock and evenly blended with the pulp feedstock in a papermaking process step, and said bulking promoter comprising at least one compound selected from the group consisting of, an amine compound, AND an acid salt of an amine compound, wherein the amine compound and an acid salt of an amine compound are compounds represented by the following formulae ($a_4$) to ($d_4$):

(a4)

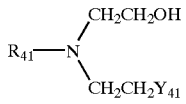

(b4)

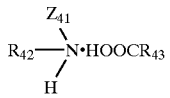

(c4)

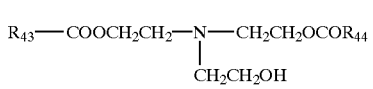

-continued (d4)

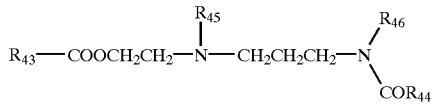

wherein $R_{41}$ is an alkyl, alkenyl, or β-hydroxyalkyl group having 8 to 35 carbon atoms;

$R_{43}$ and $R_{44}$ are same as or different from each other, an alkyl, alkenyl, or β-hydroxyalkyl group having 7 to 35 carbon atoms;

$R_{46}$ is a hydrogen atom or an alkyl group having 1 to 3 carbon atoms;

$R_{45}$ is an alkyl group having 1 to 3 carbon atoms;

$R_{42}$ is a hydrogen atom or $R_{47}$, $R_{47}$ being an alkyl, alkenyl, or β-hydroxyalkyl group having 7 to 35 carbon atoms;

$Y_{41}$ is a hydrogen atom or —$COR_{44}$; and $Z_{41}$ is —$CH_2CH_2O(AO)n_{21}$—$OCOR_{47}$, wherein A is a linear or branched alkylene unit having 2 to 3 carbon atoms and $n_{41}$ is an average added-number ranging from 1 to 20, or —CH2CH(OH)—$CH_2OCOR47$.

3. The process as claimed in claim 1 or 2, wherein said bulking promoter in said step of making paper further comprises at least one of the nonionic surfactants represented by (A) to (C):

(A): a compound represented by the following formula (A)

$$R_{81}O\ (EO)_{m18}(PO)_{n81}H \quad (A)$$

wherein $R_{81}$ is a C6 to C22 straight or branched alkyl or alkenyl group or an alkylaryl group having a C4 to C20 alkyl group;

E is an ethylene unit;

P is a propylene unit;

$m_{81}$ and $n_{81}$ are an average number of added moles, $m_{81}$ is a number in the range of 0 to 20 and $n_{81}$ is a number in the range of 0 to 50; and the addition form of EO and PO may be any of block and random and the addition order of EO and PO may not be limited;

(B): a compound represented by the following formula (B)

$$R_{81}COO(EO)_{m81}(PO)_{n81}R_b \quad (B)$$

wherein $R_{81}$, E, r, $P_{m81}$ and $n_{81}$ are the same as those of the formula (A); and $R_b$ is H, an alkyl group, an alkenyl group or an alkylaryl group;

(C): a nonionic surfactant selected from the following (1) to (3):

(1) a nonionic surfactant based on fat, (2) a nonionic surfactant based on sugar alcohol, and (3) a nonionic surfactant based on sugar.

4. The process as claimed in claim 1 or 2, wherein the blended mixture of the pulp feedstock and said bulking promoter is subjected to a sheet-forming step.

5. The process as claimed in claim 1 or 2, wherein said bulking promoter is added in an amount of 0.01 to 10 wt % based on the weight of the pulp.

* * * * *